United States Patent [19]

Wisniewski

[11] Patent Number: 4,681,234

[45] Date of Patent: Jul. 21, 1987

[54] WRENCH RACK

[76] Inventor: Mark S. Wisniewski, 38 Milk St., Blackstone, Mass. 01504

[21] Appl. No.: 838,905

[22] Filed: Mar. 12, 1986

[51] Int. Cl.[4] ..... A47F 7/00

[52] U.S. Cl. ..... 211/70.6; 211/60.1; 206/377

[58] Field of Search ..... 211/70.6, 60.1, 70.3, 211/69.1, 69, 70.2; 206/377, 376, 379

[56] References Cited

U.S. PATENT DOCUMENTS

D. 148,422 1/1948 Kane ..... 206/377 X 935,419 9/1909 Smith ..... 211/60.1 X 1,973,188 9/1934 Verderber ..... 206/377 X 2,316,771 4/1943 Davis ..... 211/60.1

FOREIGN PATENT DOCUMENTS 598385 5/1960 Canada ..... 211/70.6

*Primary Examiner*—Robert W. Gibson, Jr.

*Assistant Examiner*—Blair M. Johnson

[57] ABSTRACT

A rack for Allen wrenches with grooves for accepting the wrenches which slant first upwardly and then after a 90° turn downwardly and with surfaces intersecting to provide a line bottom to each groove.

6 Claims, 5 Drawing Figures

WRENCH RACK

FIELD OF THE INVENTION

This invention relates to a rack for holding Allen wrenches of differing sizes.

BACKGROUND OF THE INVENTION

Allen wrenches come in sets of differing sizes of wrench, and it has been difficult to organize these in a way that makes the desired size easily and quickly accessible and easily and quickly re-rackable.

SUMMARY OF THE INVENTION

I have discovered that the above difficulties are overcome in a simple, practical, and inexpensive way if there is provided a rack carrying a plurality of grooves, each groove being defined in longitudinal cross-section by a pair of groove portions intersecting at an angle of 90°, and in transverse cross section by a pair of arcs on transversely spaced centers, intersecting to define a line along the bottom of each groove portion.

In a preferred embodiment, the rack is of molded plastic, in one piece of about the same thickness throughout.

DESCRIPTION OF THE PREFERRED EMBODIMENT

The preferred embodiment, shown in the drawings, has the structure and mode of operation now described.

Drawings

Figure 2:
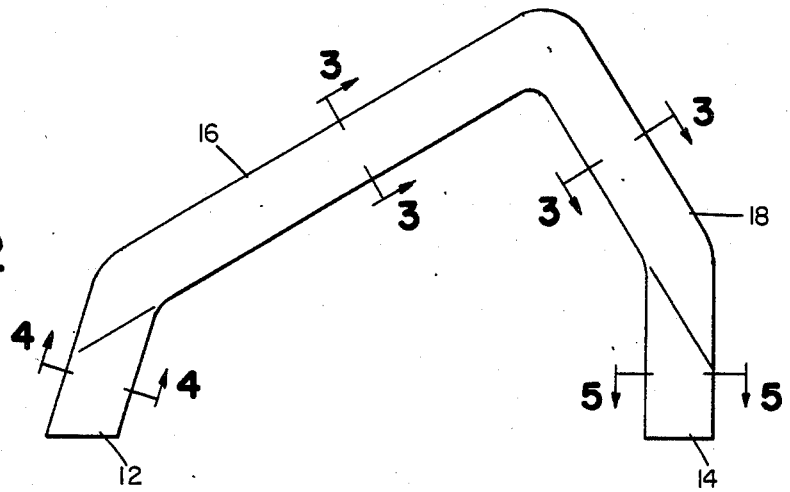
FIG. 2 is an end elevation view thereof.
Figure 4:
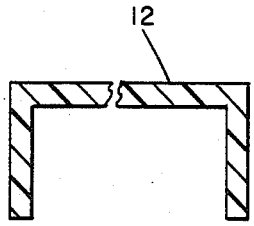

FIG. 4. is a partial sectional view, taken at 4—4 of FIG. 2.

Figure 5:
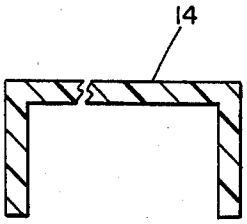

FIG. 5 is a partial sectional view, taken at 5—5 of FIG. 2.

Structure

Figure 1:
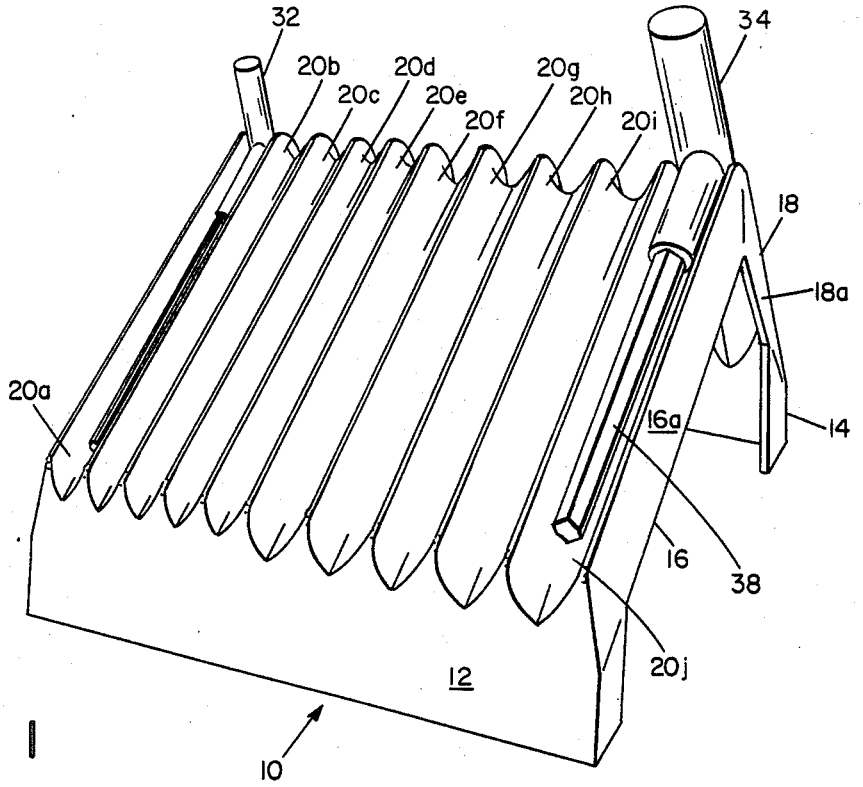
FIG. 1 is a isometric view of the preferred embodiment.

There is shown in FIG. 1 an Allen wrench rack indicated generally at 10, formed by molding plastic (injection molded polypropylene), with a front support portion 12, a rear support portion 14, a front rack portion 16, and a rear rack portion 18. Side panels 16*a* and 18*a* of portions 16 and 18 taper upwardly inwardly. The thickness of the walls forming the various parts of the rack are the same throughout the rack, as near as may be.

Extending along rack portions 16 and 18 are a multiplicity of grooves 20*a* through 20*j*. The depth of the grooves is progressively larger from left to right in FIG. 1 (i.e., from 20*a* to 20*j*). Each groove is of the same cross-sectional size and shape along its portion 16 length and its portion 18 length, the two lengths of each groove intersecting to provide a corresponding corrugation at the top of the rack, as shown.

Figure 3:
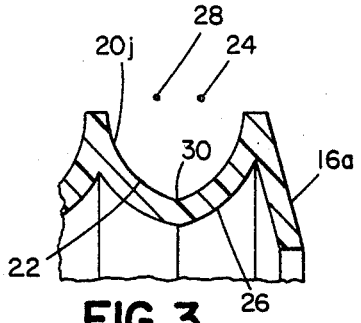
FIG. 3 is a partial sectional view, taken at 3—3 of FIG. 2, through one of the grooves.

Each groove is defined by the line intersection of a pair of arcs, in cross-section, as shown in FIG. 3, which shows the rightmost groove. In it, arc 22 about center 24 intersects arc 26 about center 28 to define line 30, which extends up portion 16 and down portion 18.

Operation

Each groove is well adapted to seat, in a firm and stable way, one of a set of Allen wrenches, smallest at the left in FIG. 1, and larger ranging toward the right. Two such wrenches 32 and 34 of a set are shown in FIG. 1. Owing to the double arc line configuration of the grooves, they accept easily and stably even Allen wrenches in which the shank 38, unlike that shown in FIG. 1, is longer, in its direction parallel with its handle, than it is perpendicular thereto (i.e., transversely of its groove).

The overall shape of the rack makes also for rack stability on a working surface, and for ease and economy of injection molding.

Other embodiments within the following claims will occur to one skilled in the art.

What is claimed is:

1. The combination comprising a wrench rack, and

T-shaped wrenches supported by said rack, said wrenches having shanks and handles perpendicular to said shanks, said combination comprising a front portion extending upwardly and rearwardly, a back portion extending downwardly and rearwardly, a multiplicity of grooves extending upwardly in said front portion and then downwardly in said back portion, said grooves intersecting at the top of said rack at an angle of 90°, said grooves being open along their lengths to facilitate access to them, said grooves in said front portion being sufficiently long, and said front portion being positioned, to accommodate said shanks of said wrenches therein, said grooves in said back portion being sufficiently long, and said back portion being positioned, to accommodate said handles of said wrenches.

2. The combination of claim 1 in which each groove is defined by two surfaces curved in one direction and intersecting in a line.

3. The combination of claim 2 in which said surfaces are in transverse cross-section the arcs of circles drawn about transversely spaced centers.

4. The combination of claim 1 which includes also front and back support portions.

5. The combination of claim 1 of unitary plastic single thickness construction.

6. The combination of claim 1 wherein said wrenches are Allen wrenches.

* * * * *